US006012939A

United States Patent [19]

Kunert et al.

[11] Patent Number: 6,012,939

[45] Date of Patent: Jan. 11, 2000

[54] MULTIFUNCTION FASTENING APPARATUS

[75] Inventors: Steven R. Kunert; Blayne Medema, both of Cedar Rapids, Iowa

[73] Assignee: Norand Corporation, Cedar Rapids, Iowa

[21] Appl. No.: 08/922,771

[22] Filed: Sep. 3, 1997

Related U.S. Application Data

[60] Provisional application No. 60/025,377, Sep. 3, 1996.

[51] Int. Cl.[7] ..... H01R 13/627

[52] U.S. Cl. ..... 439/362; 439/701

[58] Field of Search ..... 439/362, 364, 439/355, 352, 353, 701

[56] References Cited

U.S. PATENT DOCUMENTS

| | | | |
|---|---|---|---|
| 2,526,325 | 10/1950 | Burtt et al. | 439/364 |
| 4,934,950 | 6/1990 | Green et al. | 439/362 |
| 5,271,689 | 12/1993 | Ishii et al. | 439/364 |
| 5,376,016 | 12/1994 | Inaba et al. | 439/364 |
| 5,639,257 | 6/1997 | Yamaguchi et al. | 439/364 |
| 5,820,401 | 10/1998 | Hasz et al. | 439/364 |

*Primary Examiner*—Hien Vu
*Attorney, Agent, or Firm*—Suiter & Associates PC

[57] ABSTRACT

A multi-function fastening apparatus for removably attaching an accessory device to a portable data collection terminal and for joining together two or more sections of the accessory device's housing. The multi-function fastening apparatus may include a seal or the like to provide environmental protection to the accessory device's internal electronic components.

11 Claims, 4 Drawing Sheets

MULTIFUNCTION FASTENING APPARATUS

CROSS REFERENCES

The present application claims the benefit, under 35 U.S.C. § 119(e), of the United States Provisional Application Ser. No. 60/025,377 filed Sep. 3, 1996. Said Provisional Application Ser. No. 60/025,377 is herein incorporated in its entirety.

BACKGROUND OF THE INVENTION

The present invention relates generally to portable data collection terminals and more specifically to apparatus for removably attaching an accessory device to the housing of a portable data collection terminal.

Portable data collection terminals often employ a variety of interchangeable accessory devices such as optical indicia readers, radio transceivers, or the like so that they may be configured to perform a particular task or series of tasks. Typically, these accessory devices may be enclosed in interchangeable pods or housings which may be attached to the data terminal by fastening devices. Preferably, these fastening devices must provide a robust attachment between the data terminal and accessory device while allowing quick and easy replacement of the accessory device by the user.

In many applications, portable data terminals must be capable of withstanding harsh environments and rough handling without suffering damage. The accessory devices employed by the data terminals must also be capable of withstanding these environments. Consequently, it is desirable that the accessory devices have housings comprising relatively few parts which are rugged and which may be more readily sealed against the environment. To this end, it is desirable to provide a fastening apparatus capable of joining two halves of an accessory device's housing together while providing a means of securely attaching the accessory device to the data terminal.

SUMMARY OF THE INVENTION

Therefore, a principal object of the present invention is to provide a multi-function fastening apparatus for removably attaching an accessory device to a portable data terminal wherein the multi-function fastening apparatus also joins two or more sections of the accessory device's housing together.

Another object of the present invention is to provide a multi-function fastening apparatus capable of maintaining a secure attachment between the accessory device and the data terminal in the event of inadvertent mishandling.

A further object of the present invention is to provide a fastening apparatus for joining two or more sections of an accessory device's housing together while maintaining an environmental seal to protect the device's internal electronic components.

In accordance with these objects, the present invention provides a portable data collection terminal comprising a main housing onto which an accessory device housing may be removably attached. A multi-function fastening apparatus may be provided to join together two or more sections of the accessory device's housing and to removably attach the accessory device to the data terminal. The multi-function fastening apparatus may include a seal or the like to provide environmental protection to the accessory device's internal electronic components.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to the presently preferred embodiment of the invention, an example of which is illustrated in the accompanying drawings.

Figure 1:
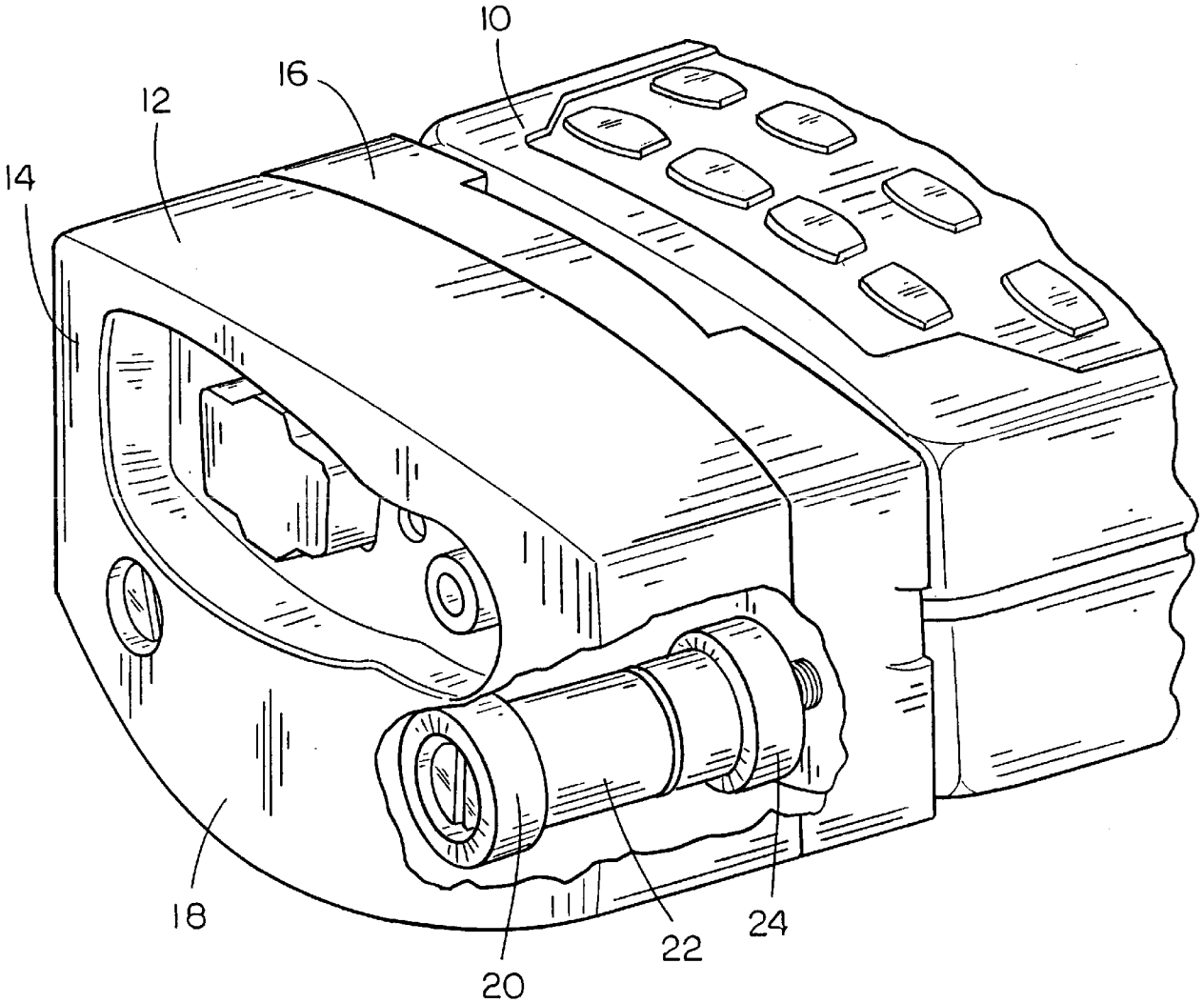
FIG. 1 is a pictorial view depicting a portable data terminal having an accessory device employing a multi-function fastening apparatus according to an exemplary embodiment of the present invention.

FIG. 1 depicts a typical portable data collection terminal 10 which may employ an interchangeable accessory device 12. A multi-function fastening apparatus 20 may be provided to join together the two sections or halves 14 and 16 of the accessory device's housing 18 and to removably attach the accessory device 12 to the data terminal 10.

Figure 2:
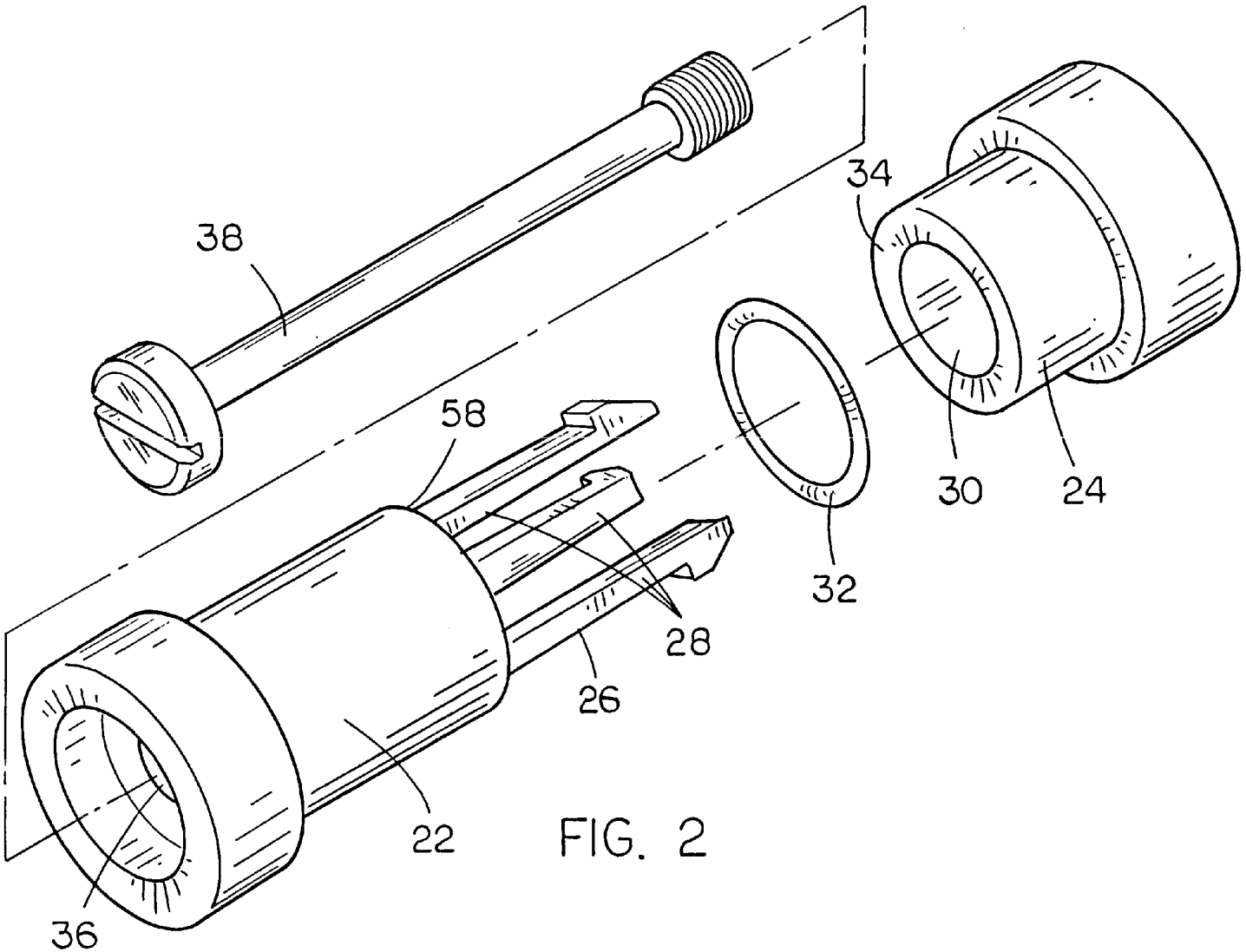
FIG. 2 is an exploded view showing the multi-function fastening apparatus disclosed in FIG. 1.

As illustrated in FIG. 1 and in the exploded view of FIG. 2, the multi-function fastening apparatus 20 preferably includes a boss 22 and a boss receptacle 24 which may be molded, adhered or otherwise attached to each half of the accessory device's housing 18. The boss 22 may be attached to the outer half 14 of the housing 18 while the boss receptacle 24 may be attached to the inner half 16 of the housing 18 so that the boss 22 and boss receptacle 24 are preferably aligned when the halves 14 and 16 of the housing 18 are assembled together. A snap fastener 26 may be mounted on the inner face 58 of the boss 22. This snap fastener 26 may comprise a series of resilient prongs 28 which may extend through an aperture 30 disposed in the boss receptacle 24 to securely join the housing halves 14 and 16 together. An environmental seal such as an O-ring 32 or the like may be disposed between the inner faces 58 and 34 of the boss 22 and boss receptacle 24 to provide environmental protection to the accessory device's internal electronic circuitry (not shown). Each boss 22 and boss receptacle 24 may have a cylindrical aperture 30 and 36 disposed therein extending longitudinally through its center. When the two housing halves 14 and 16 are assembled together and the boss 22 and boss receptacle 24 are aligned, these apertures 30 and 36 are likewise aligned forming a single cylindrical aperture extending longitudinally through the entire housing 18. A screw-type fastener 38 may be inserted and retained in this aperture so that it extends through the accessory device's housing 18 and may be attached to a threaded hole 54 (FIG. 4) in the data terminal's housing 56 (FIG. 4).

Figure 3:
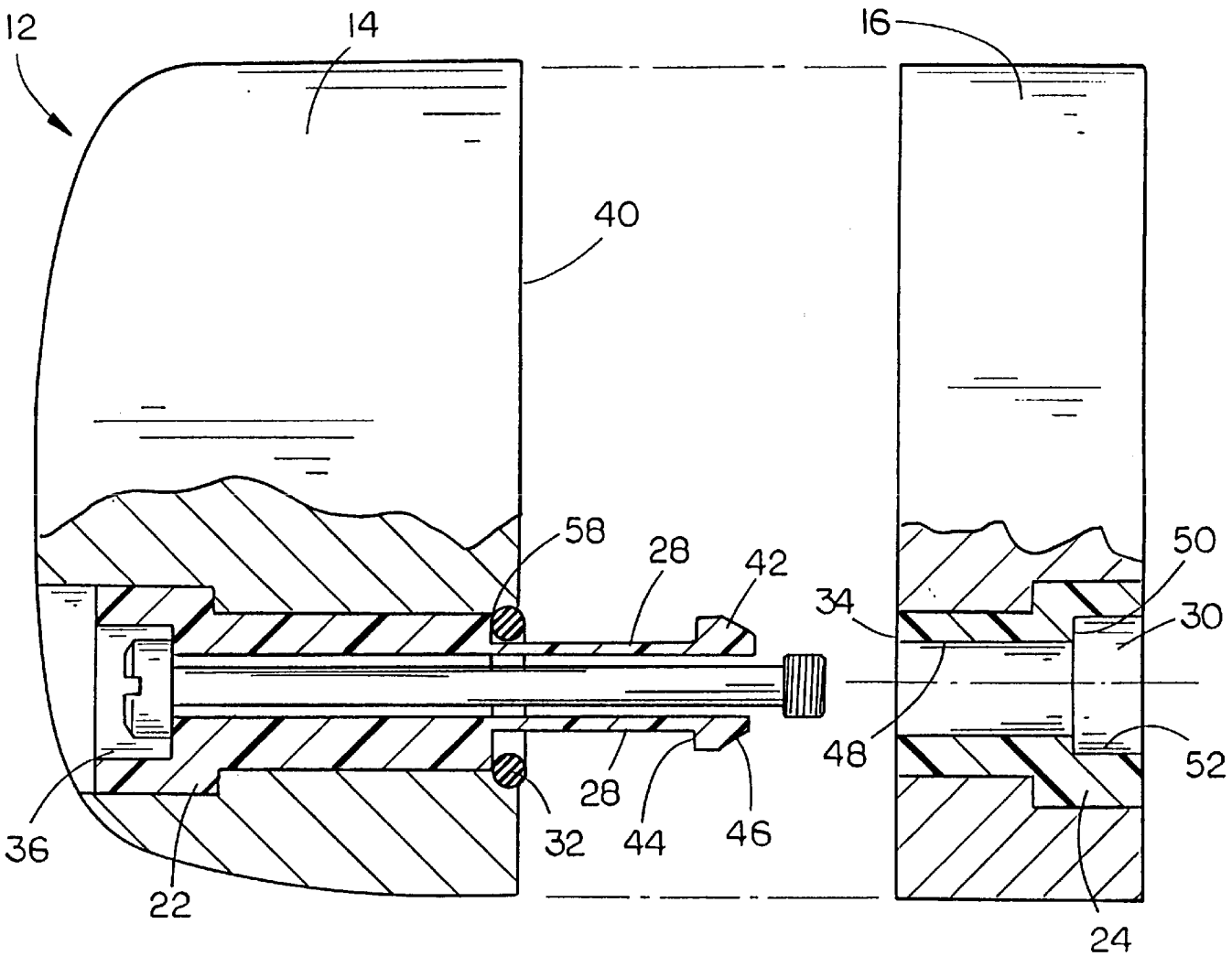
FIG. 3 is a partial cross-sectional view of the data terminal and accessory device shown in FIG. 1 illustrating assembly of the multi-function fastening apparatus.
Figure 4:
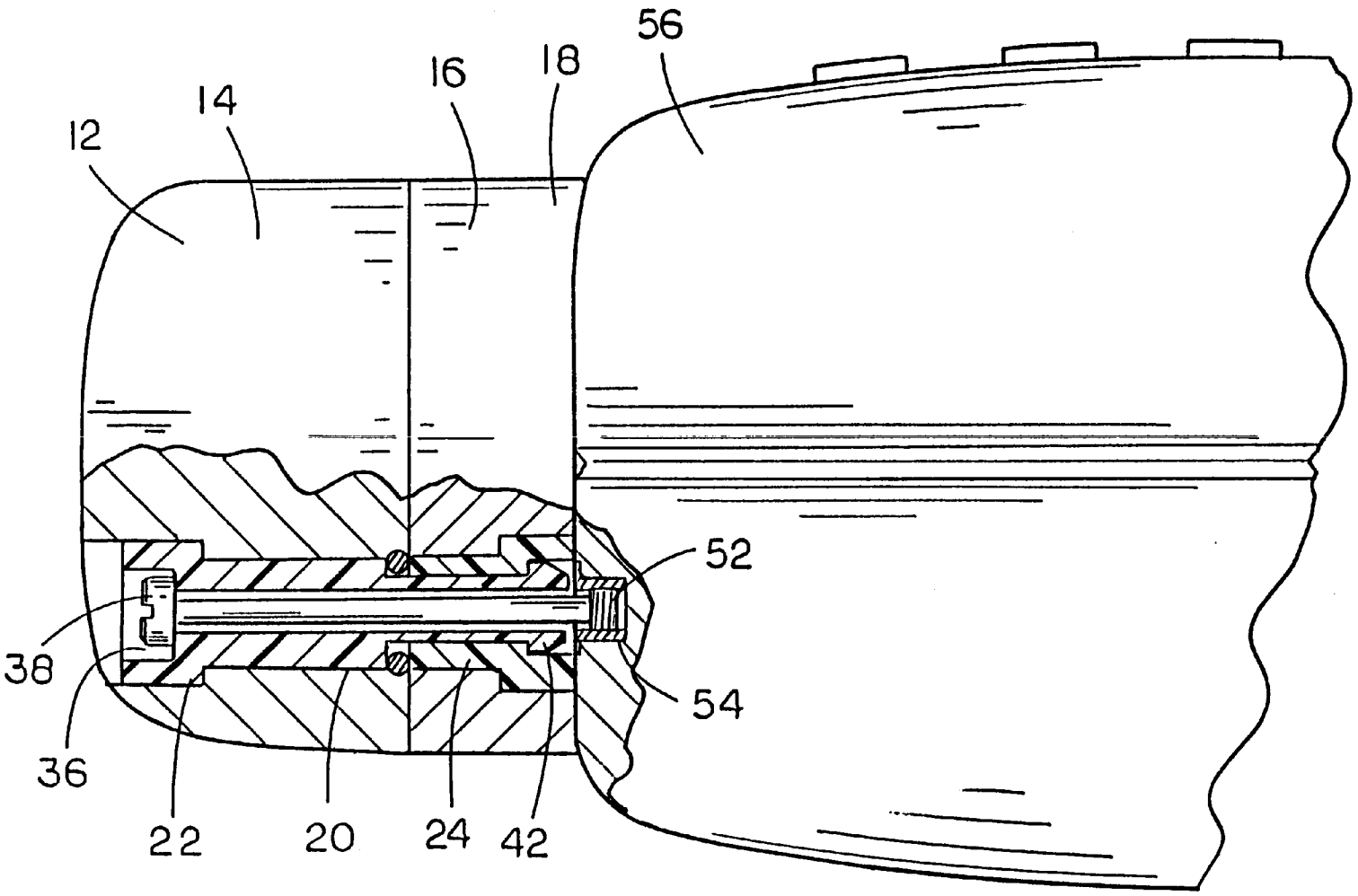
FIG. 4 is a side elevational partial cross-sectional view illustrating the fully assembled fastening apparatus being used to removably attach the accessory device to the data terminal.

FIGS. 3 and 4 depict the assembly of the accessory device's housing halves 14 and 16 utilizing the multi-function fastening apparatus 20 to secure the halves 14 and 16 together. The boss 22 having a first aperture 36 centrally disposed therein may be molded to the interior surface of the outer housing half 14. Similarly, the boss receptacle 24 having a second aperture 30 centrally disposed therein may be molded to the interior surface of the inner housing half 16. A plurality of resilient prongs 28 may be symmetrically molded to the inner face 58 of the boss 22 so that they encircle the first aperture 36 and extend beyond the inner face 40 of outer housing half. Preferably, each of the prongs 28 may have an enlarged conical head 42 having a flattened inner face 44 and a tapered outer face 46. As the prongs 28 are inserted into the second aperture 30 disposed within the boss receptacle 24, the tapered outer faces 46 slide against the aperture walls 48 and compress the prongs 28 together allowing them to extend into the second aperture 30. When the prongs 28 are fully inserted into the second aperture 30, the heads 42 of the prongs 28 are allowed to expand so that the flattened inner face 44 of the prongs 28 may rest against an inner ledge 50 disposed in an area of enlarged diameter 52 of the aperture 30. In this manner, the prongs 28 may be retained in the aperture 30 securing the two housing halves 14 and 16 together. The O-ring 32 may encircle the prongs 28 and may be retained between the inner faces 58 and 34 of the boss 22 and boss receptacle 24. When the two housing halves 14 and 16 are assembled together, this O-ring 32 may provide an environmental seal to prevent moisture or other contaminants from entering the accessory device 12 through the fastening apparatus 20.

As shown in FIG. 4, a screw-type fastener 38 may be inserted and retained in the boss 22. This screw-type fastener 38 may comprise a threaded end 52 which may extend beyond the accessory device's housing 18. The threaded end 52 may be removably inserted into a threaded hole 54 in the data terminal's housing 56 in order to secure the accessory device 12 to the data terminal 10.

In view of the above detailed description of a preferred embodiment and modifications thereof, various other modifications will now become apparent to those skilled in the art. The claims below encompass the disclosed embodiments and all reasonable modifications and variations without departing from the spirit and scope of the invention.

What is claim is:

1. A portable data collection terminal comprising:

a main data collection terminal housing;

an accessory device housing formed from two or more accessory device housing sections, said accessory device housing removably attachable to said main data collection terminal housing; and a fastening apparatus joining together said two or more accessory device housing sections, said fastening apparatus further removably attaching said accessory device housing to said main data collection terminal housing.

2. The portable data collection terminal of claim 1, wherein said fastening apparatus comprises:

a boss attached to a first accessory device housing section, said boss extending at least partially into said accessory device housing, said boss including a cylindrical aperture;

a boss receptacle attached to a second accessory device housing section, said boss receptacle extending at least partially into said accessory device housing, said boss receptacle including a cylindrical aperture;

an snap fastener attached to said boss, said fastener having at least one resilient prong extending through the aperture of said boss receptacle to removably attach said boss to said boss receptacle, wherein the apertures of said boss and said boss receptacle are aligned; and a screw fastener for removably attaching said accessory device housing to said main housing, said screw fastener removably inserted in and extending through the aligned apertures of said boss and said boss receptacle, and said screw fastener engaging said main data collection terminal housing.

3. The portable data collection terminal of claim 2, wherein said screw fastener is retained in the aperture of said boss.

4. The portable data collection terminal of claim 2, wherein said screw fastener is retained in the aperture of said boss receptacle.

5. The portable data collection terminal of claim 2, further comprising an environmental seal disposed between said boss and said boss receptacle.

6. The portable data collection terminal of claim 5, wherein said environmental seal comprises an O-ring.

7. An accessory device for use with a portable data collection terminal, comprising:

an accessory device housing formed from two or more accessory device housing sections, wherein said accessory device housing is removably attachable to said notable data collection terminal;

a fastening apparatus joining together said two or more accessory device housing sections, said fastening apparatus further adapted to attach said accessory device housing to said portable data collection terminal wherein said fastening apparatus comprises:

a boss attached to a first accessory device housing section, said boss extending at least partially into said accessory device housing, said boss including a cylindrical aperture;

a boss receptable attached to a second accessory device housing section, said boss receptable extending at least partially into said accessory device housing, said boss receptable including a cylindrical aperture;

an snap fastener attached to said boss, said fastener having at least one resilient prong extending through the aperture of said boss receptable to removably attach said boss and said boss receptable, wherein the aperture of said boss and said boss receptable are aligned; and a screw fastener for removably attaching said accessory device housing to said portable data collection terminal, said screw fastener removably inserted in and extending through the aligned apertures of said boss and said boss receptable, and said screw fastener adapted to engage said portable data collection terminal.

8. The accessory device of claim 7, wherein said screw fastener is retained in the aperture of said boss.

9. The accessory device of claim 7, wherein said screw fastener is retained in the aperture of said boss receptacle.

10. The accessory device of claim 7, further comprising an environmental seal disposed between said boss and said boss receptacle.

11. The accessory device of claim 10, wherein said environmental seal comprises an O-ring.

* * * * *